US012281486B2

(12) United States Patent
Rodgers

(10) Patent No.: US 12,281,486 B2
(45) Date of Patent: Apr. 22, 2025

(54) DEPLOYABLE SHELTER WITH INFLATABLE FRAME

(71) Applicant: Rigloo Ltd., Biggar (GB)

(72) Inventor: Iain Raymond Rodgers, Biggar (GB)

(73) Assignee: Rigloo Ltd., Biggar (GB)

( * ) Notice: Subject to any disclaimer, the term of this patent is extended or adjusted under 35 U.S.C. 154(b) by 61 days.

(21) Appl. No.: 17/980,999

(22) Filed: Nov. 4, 2022

(65) Prior Publication Data

US 2023/0193650 A1 Jun. 22, 2023

(30) Foreign Application Priority Data

Sep. 7, 2021 (GB) ..... 2112749

(51) Int. Cl.
*E04H 15/20* (2006.01)
*E04H 15/56* (2006.01)

(52) U.S. Cl.
CPC ..... *E04H 15/20* (2013.01); *E04H 15/56* (2013.01); *E04H 2015/201* (2013.01)

(58) Field of Classification Search
CPC .... E04H 15/20; E04H 15/56; E04H 2015/201
See application file for complete search history.

(56) References Cited

U.S. PATENT DOCUMENTS

| | | | | |
|---|---|---|---|---|
| 9,970,207 | B2 * | 5/2018 | Wasson | E04H 15/20 |
| 10,730,808 | B2 * | 8/2020 | Lyu | C05F 17/986 |
| 2008/0032393 | A1 * | 2/2008 | Bauer | C05F 17/964 435/290.1 |
| 2013/0104947 | A1 * | 5/2013 | Hotes | E04H 15/34 135/96 |
| 2017/0081867 | A1 * | 3/2017 | Wasson | E04H 15/02 |
| 2020/0308865 | A1 * | 10/2020 | Milo | E04H 15/20 |

FOREIGN PATENT DOCUMENTS

| | | | | |
|---|---|---|---|---|
| DE | 8627545 | * | 1/1988 | |
| WO | WO-2006125956 | A1 * | 11/2006 | E04H 1/1277 |

* cited by examiner

*Primary Examiner* — Mark R Wendell
(74) *Attorney, Agent, or Firm* — MaxGoLaw PLLC

(57) ABSTRACT

A deployable shelter having an inflatable frame arrangement over which is disposed a flexible, the shelter having a deployed configuration and a stowed configuration, which in the deployed configuration the inflatable frame has at least two arched frame members, at least one elongate upper frame member linking together the arched members and two elongate side members, each linking the leg portions of the arched members, the elongate side members connected to the leg portions of the arched frame members so as not to be in contact with the ground or base sheet, in use, and defining, on each leg portion, a foot projection configured to make contact with the ground or base sheet. The deployable shelter is portable and rapidly deployable through inflation of an inflatable frame, of being configured to minimize contact of inflatable elements with the ground.

20 Claims, 4 Drawing Sheets

DEPLOYABLE SHELTER WITH INFLATABLE FRAME

RELATED APPLICATIONS

This application is a Paris convention filing that claims priority benefit of UK Patent Application No 2112749.3 filed Sep. 7, 2021; the contents of which are hereby incorporated by reference.

FIELD OF THE INVENTION

The present invention relates to an emergency shelter that can readily be deployed.

BACKGROUND OF THE INVENTION

Adventure and leisure activities, such as hiking, hill walking, mountain climbing, abseiling, cycling, fishing and many others are increasingly common. Naturally, these activities have potential risks, from a change of weather or an accident and the need for shelter can become pressing.

A similar need can readily arise in the event of vehicle breakdown where it is imperative that the occupants of a vehicle leave the vehicle which may be vulnerable on or by the road, but this can leave them exposed to the elements.

Recovery services, whether for roadside breakdown or mountain rescue, need to provide temporary shelter for vehicle occupants while they fix a vehicle or for injured persons as they treat or stabilise their injury before transport.

Emergencies or disasters also readily require shelter for victims of the disaster at short notice, which can be readily deployed and used as the lack of shelter can quickly become life threatening.

The shelter needs to be portable, rapidly deployable and adaptable.

The present inventor has devised a solution that meets these needs.

Problem to be Solved by the Invention

There is a need for a shelter for use in various emergency situations that is rapidly deployable and adaptable for various uses.

It is an object of this invention to provide a compact, transportable and rapidly deployable shelter for use in leisure, rescue, roadside and disaster situations.

It is an object of this invention to provide a rapidly deployable shelter that is readily adaptable for various uses.

It is a further object of this invention to provide a rapidly deployable shelter that can be readily used for treating injured persons or fixing equipment.

SUMMARY OF THE INVENTION

In accordance with a first aspect of the invention, there is provided a deployable shelter comprising an inflatable frame arrangement and a flexible cover disposed or formed thereover, the shelter having a deployed (and inflated) configuration and a stowed (and deflated) configuration, which in the deployed configuration the inflatable frame comprises at least two (preferably at least three) arched frame members, each defining an upper arch portion and two leg portion, the frame having at least one elongate upper frame member linking together the arched members at an upper portion thereof and two elongate side members, each linking the leg portions of the arched members, the elongate side members connected to the leg portions of the arched frame members so as not to be in contact with the ground or base sheet, in use, and defining, on each leg portion, a foot projection configured to make contact with the ground or base sheet.

In a second aspect of the invention, there is provided a deployable shelter comprising an inflatable frame arrangement and a flexible cover disposed or formed thereover, the shelter having a deployed (and inflated) configuration and a stowed (and deflated) configuration, and further comprising one or more of the following:

- a movable or removable floor;
- one or more valve access apertures formed in the flexible cover;
- one or more vents are provided in the flexible cover;
- an end that is defined solely by an arched frame member and no base members; and
- an external perimeter ballast-receiving means, which is preferably configured for receiving a ballast for holding the shelter in place.

Advantages of the Invention

The deployable shelter has the advantage, in addition to being portable and rapidly deployable through inflation of an inflatable frame, of being configured to minimise contact of inflatable elements with the ground, thereby decreasing the risk of puncture or damage to the inflatable frame, while increasing the proportion of the floor that can be removed.

DETAILED DESCRIPTION OF THE INVENTION

Figure 1:
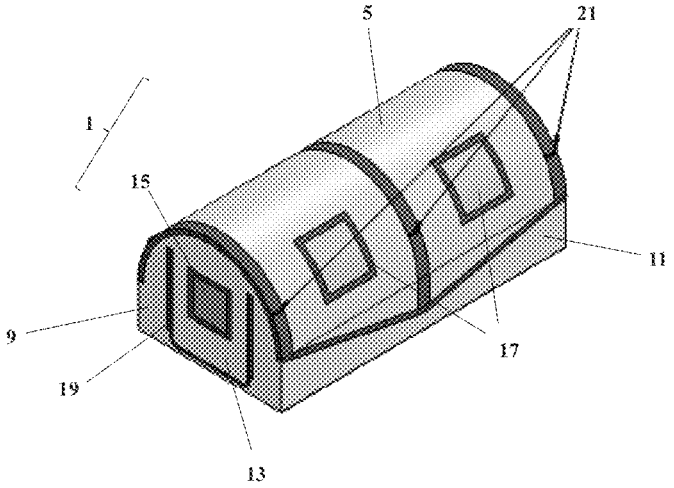
FIG. 1 is a perspective view of a shelter in accordance with one embodiment of the invention.

The present invention concerns a deployable shelter comprising an inflatable frame arrangement and a flexible cover disposed or formed thereover. The shelter has a deployed (and inflated) configuration and a stowed (and deflated) configuration. When in the deployed configuration, the inflatable frame comprises at least two (preferably at least three) arched frame members, each defining an upper arch portion and two leg portions. The frame has at least one elongate upper frame member linking together the arched members at an upper portion thereof and two elongate side members, each linking the leg portions of the arched members. The elongate side members are connected to the leg portions of the arched frame members in such a way as to be raised or so as to not be in contact with the ground or a base sheet in use, and to define a foot projection on each leg portion, which foot projection is configured to make contact with the ground or a base sheet.

By base sheet, it is meant any base or ground sheet used with the frame or shelter and preferably the base sheet is provided by a floor portion of a flexible cover.

Preferably, the side members are disposed relative to the leg portions of the arched frame members such that the foot projections extend from a junction of the side member and leg portion of an arched frame member by at least 15 mm. Preferably, the foot projections extend from a lower point of the junction of the side member and the leg portion. Preferably, the foot projections extend by an amount from 20 to 250 mm, preferably 25 to 100 mm, more preferably 30 to 75 mm and still more preferably 40 to 60 mm, e.g. about 50 mm.

The foot projections project generally downwards from the leg portions (or continue the trajectory or curve of the leg portions).

By the side members being disposed so as to define foot portions by way of the junction or connection point between the arched frame members, the side members are effectively raised above the ground or floor of the shelter by the extent of the foot projections. Preferably, there are no ground-contacting side elongate members or portions thereof, and preferably no ground contacting transverse end base members. Preferably, the end frame members consist of the arched frame. Indeed, it is preferred that the foot portions of the arched frame members provide the only contact with the ground or with the floor of the shelter of the entire frame arrangement. Thus, contact of the inflatable side members with the ground is avoided and contact of the inflatable frame arrangement with the ground is minimized. Thereby, the risk of puncture of the inflatable frame arrangement by way of contact with any sharp objects on the ground is minimised.

The frame may comprise any number of arched frame members each disposed laterally across the shelter and disposed along the length of the shelter on a common axis. Preferably, the frame comprises at least three arched frame members (and more preferably comprises three arched frame members), preferably equally separated. Preferably, two of the arched frame members are end members, by which it is meant they are disposed against or at the end of the shelter. Preferably one or more (preferably one) further arched frame members are disposed intermediate between the two end arch members.

The arched frame members preferably define a profile shape of a rectangle surmounted by a semi-circle or semi-ellipse defining a form of arch (or a norman window shape). According to this embodiment, the 'rectangle' portion is provided by straight leg lower portions of the arched frame member while the 'semi-circle' or 'semi-ellipse' portion is provided by a curved upper arch portion.

Preferably at least one upper frame member and each of at least two side frame members extend the full length of the shelter from one end arched frame member to the other end arched frame member, or are in-effect extending the full length by way of successive upper and side frame member portions extending between successive arched frame members along the length of the shelter. The successive upper and side frame member portions preferably extend along a single longitudinal axis from end to end of the shelter, or they may be staggered on different longitudinal axes.

In a preferred embodiment, the lowermost side member portions on each side together form an effective single side member extending along a full length of the shelter on a single longitudinal axis.

Preferably, the deployable shelter comprises an upper frame member in the form of a medially disposed spine member.

The upper frame members serve to give the upper frame additional structural integrity, particularly when a flexible cover is disposed or formed over the frame arrangement. The side members serve to give the arrangement of arch members structural integrity, in combination with the upper frame member(s), especially when a flexible cover is disposed or formed over the frame arrangement.

Preferably, in accordance with the present invention, the inflatable frame arrangement is absent any elongate frame members that extend along (e.g. horizontally) in contact with the ground.

The frame members may be of any suitable shape and width but are preferably generally circular cross-section and preferably have a diameter of from 50 mm to 250 mm, preferably up to 125 mm, more preferably up to 100 mm as this provides a sufficient degree of rigidity without additional support while remaining relatively lightweight. In particularly preferred embodiments, depending upon the size of the frame arrangement and shelter, the frame members (which make up the frame arrangement—e.g. arched frame members, upper frame members and side members) have an inflated diameter of from 55 to 90 mm, such as about 60 mm (for a smaller shelter) or about 80 mm (for a larger shelter).

The frame arrangement can be made of any suitable material for an inflatable frame member, typically a plastic, but preferably comprises polyurethane tubing. The frame arrangement is preferably formed of thermoplastic polyurethane (TPU) of 0.3 mm thickness. Preferably the frame arrangement comprises a single inflatable volume.

The flexible cover disposed or formed over the inflatable frame arrangement preferably comprises a floor, two opposing end walls and two opposing side walls which together extend over following the form of the arched frame members to form a roof in a generally arch-shaped profile defining a single curved surface.

The flexible cover preferably defines at least a floor of the shelter.

The floor may be unitary in that it extends the full extent of the footprint of the inflated inflatable frame arrangement.

Alternatively and in a preferred embodiment, the floor comprises a peripheral floor portion; and a medial floor portion. The medial floor portion is preferably movable between a first configuration in which the medial floor portion together with the peripheral floor portion provide a continuous and complete floor and a second configuration in which the medial floor portion is at least partially separated from the peripheral floor portion to reveal or define a hole in the floor.

In one embodiment, the medial floor portion is permanently attached along one edge thereof to the peripheral floor portion. In a preferred alternative embodiment, however, the medial floor portion is removably attachable to the peripheral floor portion.

The medial portion, in its first configuration is preferably secured to the peripheral portion temporary fixing, e.g. by a zip, hook and loop fixing, snap fixings or the like. The medial portion may be secured solely at the end portions or edges thereof (to corresponding end edges of the peripheral portion) by removably attachable fixings such as zip, hook and loop and snap fixings and optionally is also attached by the side edges thereof to corresponding edges of the peripheral portion by removably attachable fixings such as zip, hook and loop and snap fixings.

When the medial portion is detached from the peripheral portion except for at one end edge thereof, it may be rolled, scrunched or folded toward one side or end and secured thereto to keep the hole open.

Preferably, the peripheral floor portion is fixedly attached or integral with side and end walls of the flexible cover.

The medial portion preferably makes up at least 50% of the floor area, preferably at least 60% and more preferably at least 75%. Still more preferably, the medial portion makes up a greater portion, e.g. at least 80%, more preferably at least 85% and still more preferably at least 90% of the floor area. Thus, the hole that can be formed by removing or moving the medial portion can be almost the entirety of the floor.

Preferably, the peripheral floor portion is a peripheral strip, preferably of width from 80 to 200 mm more preferably from 100 to 150 mm, adjacent all four walls of the deployable shelter.

By providing a movable or removable floor, the shelter can be deployed by inflating the inflatable frame arrangement, the floor stowed (or removed) and then the shelter provided over a person or object to be sheltered without requiring that person or object to be moved. This is particularly helpful in an emergency or rescue situation where a person may be ill or injured, where moving the person is ill advised, but shelter is necessary or highly desired (e.g. to protect the injured person while medical help arrives or to provide shelter while medical treatment is being administered prior to transport.

The flexible cover may be formed of any suitable material but is preferably a water proof cover with good tear strength. The cover may be of polyester or nylon, for example. Preferably the upper cover is of polyester and the floor of nylon. Particularly preferred materials used are Polyester Ripstop™ 201T (80 g/m$^2$ with a tear strength of 12 N) as the upper cover and Nylon Ripstop™ 210T (80 g/m$^2$ with a tear strength of 20 N).

Any and preferably all of the frame members are inflatable and deflatable, which enable the shelter to be deployed rapidly and then packed away quickly.

The frame may be formed of one or a plurality of inflatable volumes which each may be inflated via one or more inflation valves. Preferably there is a single inflation volume which is preferably inflated via two inflation valves. Two openings for deflation may be provided for rapid collapse of the shelter when required.

Inflation of the inflatable frame arrangement may be by automated mechanical device such as a carbon dioxide or other fluid powered mechanism (e.g. the inflatable frame may be provided with a gas canister for a single use inflation) or may be oral or manual inflation mechanism (e.g. by a manual or electrical powered pump).

Optionally, any inflation valves, release valves or pressure release valves may be disposed on a surface of a frame member facing the flexible cover and optionally may be accessed from the outside of the shelter via corresponding valve access apertures formed in the flexible cover. Optionally, the valve access aperture is provided with a valve cover slip that extends over the aperture and may be opened, e.g. via a zip or other detachable fixing, to allow access thereto.

Preferably the flexible cover is disposed over the inflatable frame arrangement and may be secured at multiple locations to the inflatable frame member. The flexible cover may be secured to the inflatable frame by temporary or permanent fixings. Preferably, the flexible cover is secured to the inflatable frame arrangement at each side of each of each of the end arched frame members and preferably also at each side of each of the arched frame members and preferably also to the one or more medial upper member (or spine member) and/or each of the side members, preferably at each portion thereof (i.e. each portion of the elongate side or medial members that is disposed between successive arched frame members).

Suitable temporary fixings include snap fixings, hook and loop fixings, ties, or, in a particularly preferred embodiment an envelope which is sewn to the flexible cover and forms a tube shape through which the frame member passes. The envelope may be provided in two leaves which are secured together by hook and look or other temporary fixing.

In a preferred embodiment of the present invention, a shoe is provided for protecting each foot projection.

By shoe, it is meant a base for a foot projection. The base may be a planar or flat member, which may have surface features or undulations or may be absent such features. The base may comprise a partial or full rim extending upwards from the base to define a cup or recess for receiving a foot projection. Optionally the shoe and, in particular, the base of the shoe may be a reinforcing element such as a rigid plate, a cup or a flexible but thick or strong reinforcing material or fabric, e.g. a woven fabric.

In one embodiment, the shoe comprises a cup with a recess for receiving the foot projection. In another embodiment, the shoe comprises a rigid plate or reinforcing element for contacting a foot projection.

The shoe may be a discrete article or may be attached or secured to or integral with a floor portion of the flexible cover, or it may be disposed on the flexible cover.

Preferably, the shoe is configured to engage with the foot by way of a hook and loop fixing, one part of which is attached to the shoe and one part of which to the base of the foot projection.

Preferably, a shoe is provided attached or secured to a floor portion of the flexible cover at a position at each corner (i.e. adjacent to a side wall and an end wall) and on a floor portion at a position adjacent to the side wall at a location to cooperate with each foot projection.

In a preferred embodiment of the invention, the shelter further comprises an external perimeter ballast-receiving means, which his preferably configured for receiving a ballast for holding the shelter in place, the ballast-receiving means preferably disposed such that the ballast may be disposed external to the shelter adjacent to a or each side edge and/or a or each end edge.

Preferably, in one embodiment, the ballast-receiving means is provided by a skirt arrangement and/or a pocket arrangement. A skirt ballast-receiving arrangement typically comprises a skirt extending outward along each opposing side of the shelter at ground or floor level and/or extending outward along each opposing end of the shelter at ground or floor level. Optionally, the external peripheral skirt extending along each side and/or end is discrete from those along the other ends or sides. Optionally, the peripheral edge of the peripheral skirt is provided with an elasticated cord so as to cause the peripheral skirt to form an elongate pocket.

In another embodiment, the ballast-receiving means is provided by one or more (preferably waterproof) external pockets disposed on each opposing side wall and/or each opposing end wall, which external pocket is disposed at ground level and extends upward to a pocket opening, for receiving a ballast. Preferably each side and/or end wall comprises a plurality of the external pockets disposed along the length of the side wall and/or end wall.

Preferably a door is provided in one or preferably both ends of the shelter (which ends are provided by the flexible cover). The door may be formed in the flexible cover. Preferably, at least one window is provided in one or both ends of the shelter, which are preferably formed within the doors. Preferably, on one or both sides of the shelter, at least one window and preferably two windows are provided. Optionally, a window is formed in the roof of the shelter for providing light. Each window is typically formed by a translucent but more preferably transparent material within a flexible cover forming the sides of the shelter.

A door provided in the end is preferably at least 50 cm wide, e.g. from 55 to 70 cm and preferably has a height of at least 60 cm and preferably at least 75 cm.

Where windows are provided, these can be any suitable size, but are preferably at least 20 cm wide and 20 cm high and typically up to about 30 cm wide and high, to provide ample aspect and view and are preferably 22 to 28 cm wide and high. The windows are preferably provided in the upper half of the shelter to allow easy viewing while sitting or standing and are preferably centered around 70 to 100 cm from the ground.

Preferably, one or more vents may be provided in the flexible cover (and in particular the upper, being that part of the flexible cover other than the floor). Optionally, the vent is provided on one or both end walls of the shelter and/or on one or both side walls, but preferably only on the end walls. The vent is preferably disposed above a window. The vent preferably comprises a vent net (or mosquito net), preferably at or close to the apex of the arch shaped shelter (when disposed on the end of the shelter). Preferably, the vent net is ordinarily covered by a vent flap of material. Preferably, the vent may be opened by inserting deployable stop (e.g. of rigid or semi-rigid material) between vent flap and end wall, which is preferably attachable to each of the vent flap and end wall by a hook and loop fixing or snap fixing, or by being disposed into corresponding recesses.

The shelter is preferably readily configurable between a deployed configuration in which the inflatable frame is fully inflated and a transportable configuration in which the inflatable frame is deflated. The shelter may ideally fit folded and packed into a bag, such as a hold all or a rucksack.

In one embodiment, the shelter may find application for roadside emergency shelter, emergency shelter for hikers or by mountain rescue crews or as a medical rescue shelter. According to this embodiment, the shelter may have a length of from 170 to 300 cm, preferably from 180 to 275 cm and preferably from 180 to 250 cm, but is preferably at least 200 cm long. This should ideally be the size to accommodate a person lying down and more preferably is sufficiently long that the hole provided can be at least 180 cm being long enough to be disposed over an injured person. The hole (and thus the length of the medial floor portion) may be at least 150 cm, preferably at least 180 cm and typically up to about 95% of the length of the shelter, e.g. from 80 to 95% of the length of the shelter, preferably at least 85% and more preferably about 90% of the length of the shelter. The shelter may be any suitable height according to this embodiment, but is preferably at least 100 cm high, such as from 110 to say 200 cm (to allow a person to stand upright and additional room for lighting, for example), but is preferably up to 180 cm, more preferably up to 150 cm to allow ample room to move about while treating a patient seated or on knees. Any suitable width of shelter is provided according to this embodiment, but preferably up to 175 cm wide, more preferably at least 75 cm wide, more preferably at least 100 cm wide, still more preferably at last 125 cm wide and still more preferably for this purpose at least 150 cm wide. The width, to allow one person laying down and a second person by their side to treat them, with room for equipment storage, is preferably from 150 to 175 cm wide.

The packaged weight of a shelter defined above may be up to 10 kg, but is preferably from 2 to 7.5 kg, and more preferably from 3 to 5 kg for a version for carrying. The lower weight is achievable, in particular, by using a flexible cover of density less than 100 g/m$^2$ and preferably from 70 to 90 g/m$^2$.

An embodiment of the shelter, which finds particular utility for hikers and cyclists (and preferably cyclists) due to its compact form and low weight, has a length as described above (suitable to accommodate a cycle) and a medial portion (and hole) sized to fit over a cycle under repair, for example, but a width of up to 100 cm, e.g. up to 90 cm, such as from 75 to 85 cm (wide enough to receive a bike's handlebars, but narrow for minimizing weight). The height may be from 60 to 150 cm. For personal shelter for hikers and cyclists, the height may be from 60 to 100 cm, e.g. 70 to 90 cm. A shelter according to this embodiment may have a packed weight of, for example, from 2.5 to 4 kg, preferably about 3 to 5 kg.

In one embodiment, due to the lightweight nature of the shelter, it may be packed and dispatched by drone to a person in an emergency situation in need of shelter, according to pre-defined coordinates and directed by GPS (or other navigation means).

In an alternative embodiment, the sizes and shapes of the above shelters may be utilized or selected from according to preferred needs, such as without any windows (or with just one or more than one windows, but with additional inner covers) and without a removable floor as a convenient camping tent that is readily inflated.

The invention will now be described in more detail, without limitation, with reference to the accompanying Figures.

In FIG. 1, a deployable shelter 1 in deployed form takes the form of an elongate prism of a rectangle surmounted by a semi-circle or semi-ellipse defining a form of arch (or a norman window shape). A flexible cover 5 of an outer flexible material of polyester or nylon forms end walls 9 and side walls 11, the flexible cover disposed over an inflatable frame arrangement (not shown). The shelter shown in FIG. 1 has a side length of 2 m and an end width of 1 m and a height of 80 cm, being designed as a highly portable shelter with a total weight of under 5 kg.

A door 13 is formed within the cover 5 on each end wall 9 and will typically be zipped closed or closed with a hook and loop or Velcro™ closure 19 or, when open, can be rolled up and secured with tabs (not shown). A door 13 will typically have a width of 56 cm. End windows 15 are provided in end walls 9 of the shelter 1 and more particularly within the doors 13 and are formed of translucent (for light) material or more typically transparent material (for visibility). The end windows 15 are typically centred at a distance of about 42 cm from the ground to allow good lines of sight. Optionally, the windows 15 can be rolled up while keeping the doors 11 closed. Two side windows 17 are provided on one or both sides 11 of the shelter 1. The side windows 17 are typically centred about 55 cm from the ground to allow good visibility. The end windows 15 and side windows 17 are, in the embodiment of FIG. 1, about 24 cm square.

The shelter 1 of FIG. 1 is, as mentioned above, a prism of rectangle surmounted by a semicircle, which serves to provide a lower upright side wall and a curved upper portion of the shelter 1. In this particular embodiment, the rectangle has a height of 30 cm and a width of 100 cm while the semicircle has a radius of 50 cm. Grip points 21 which can also serve as guy rope stays are provided on the side walls at locations cooperating with the inflatable frame arrangement at about half the height of the shelter 1.

Figure 2A:
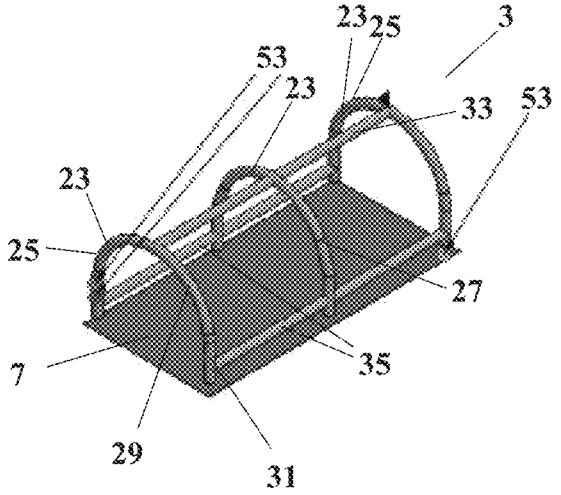
FIG. 2*a* is a perspective view of the frame arrangement with floor of the shelter of the embodiment of FIG. 1.
Figure 2B:
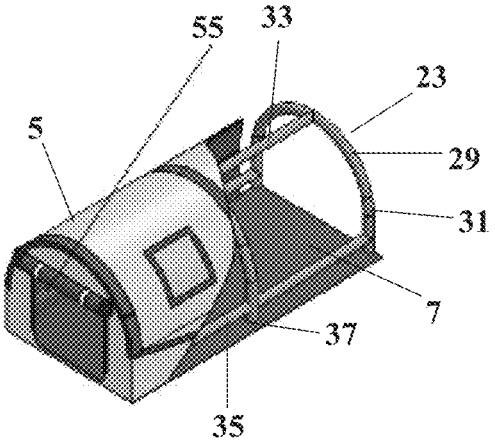
FIG. 2*b* is a perspective view of the shelter the embodiment in FIG. 1 with partial cutaway.

FIG. 2*a* shows an inflatable frame arrangement 3 and floor 7 of a shelter 1 of FIG. 1, while FIG. 2*b* shows the same but as a cut-away of the shelter 1 of FIG. 1. The inflatable frame arrangement 3 is used to support the flexible cover 5 in the shelter 1 shown in FIG. 1. The inflatable frame arrangement 3 has three arched frame members 23 (which form the cross-sectional shape of the shelter 1 of a semicircle or ellipse on a rectangle) comprising two opposing end frame members 25, one at each end of the shelter 1 and an intermediate frame member 27 disposed intermediate the two end frame members 25. Each arched frame member 23 comprises two opposing lower leg portions 31 and an upper arch portion 29. An elongate upper frame member 33 (or spine member) is medially disposed and extends along the length of the shelter 1 from one end frame member 25 to the other and serve to give the shelter structure. The spine member 33 is essentially two spine member portions, each disposed between and joined to a pair of arched frame members 23 at its upper arched portion 29.

Elongate side members 35 are disposed along the length of each side of the shelter 1 again linking the end frame members 25 and the intermediate frame member 27 and is joined to each of the arched frame members 23. The side members 35 are disposed relative to the arched frame members 23 so that that the side members 35 have about 50 mm clearance from the ground.

The portion of the leg portions 31 of the arched frame members 23 that projects downwards from the point at which the side members 35 are attached to the leg portions 31 may be referred to as the foot projections 37. Each leg portion 31 of each arched frame member 23 has a foot projection 37. The frame arrangement 3 is supported by and stands on the foot projections 37.

While the cover 5 is supported by the inflatable frame arrangement 3, the cover 5 also provides support to the inflatable frame arrangement 3. Preferably, the frame members of the frame arrangement may be secured to the cover at various points. The flexible cover 3 is best secured to the inflatable frame arrangement 3, especially at end members 25, side members 35 and spine member 33.

The inflatable frame arrangement 3 typically defines a single inflatable volume, inflated by one or more typically two inflation valves 53 and optionally provided with a pressure release valve (here also shown as 53). |Similarly one or two deflation valves which can be the same or different are provided and facilitate rapid stowage. The inflatable frame arrangement 3 is formed in this embodiment of 60 mm diameter polyurethane tubing.

The door 13 may be opened by rolling it up as shown at 55.

Figure 3:
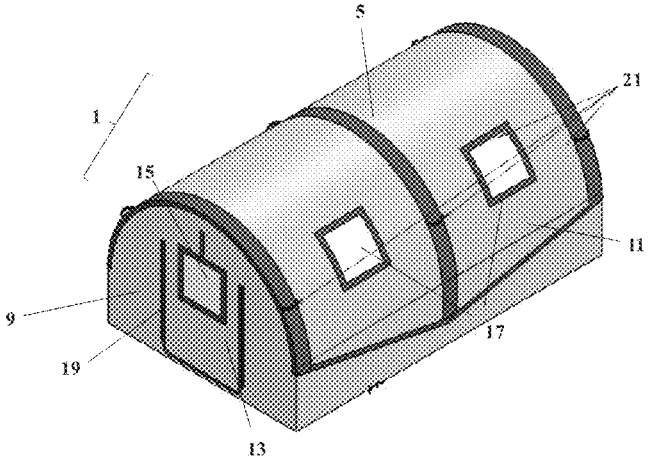
FIG. 3 is a perspective view of a variation of the shelter in accordance with one embodiment of the invention.

FIG. 3 is a deployable shelter 1 according to another embodiment and is very much similar to the embodiment of FIG. 1. Again, in FIG. 3, shelter 1 in deployed form takes the form of an elongate prism of a rectangle surmounted by a semi-circle or semi-ellipse defining a form of arch. It has a flexible cover 5 defining side walls 11 and end wall 9 having door 13 formed therein containing window 15. The door 13 is secured closed in end wall 9 by way of zip or hook and loop closure 19. Windows 17 are disposed in side wall 11. Handles 21 may be used as guy rope stays.

Figure 4A:
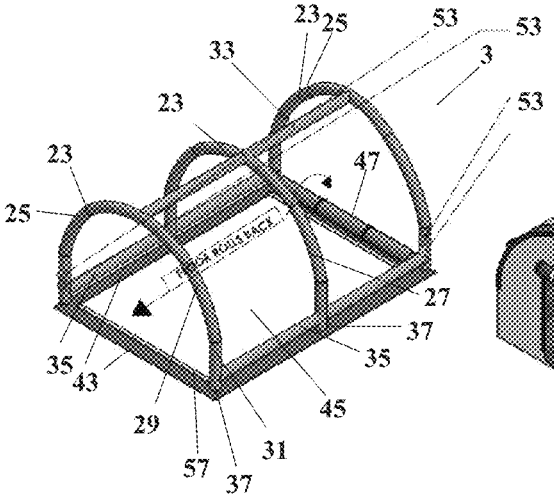
FIG. 4*a* is a perspective view of the frame arrangement with floor of the shelter of the embodiment of FIG. 3.
Figure 4B:
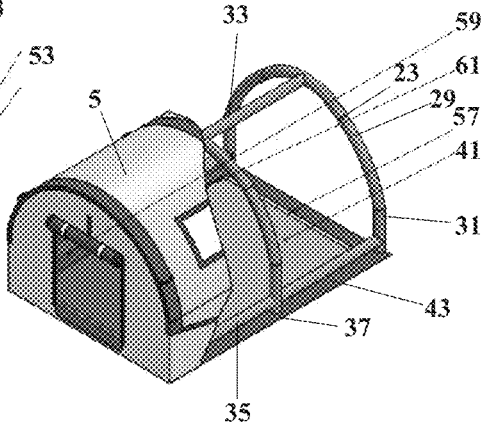
FIG. 4*b* is a perspective view of the shelter the embodiment in FIG. 3 with partial cutaway.

In FIGS. 4*a* and 4*b*, the frame arrangement 3 and floor 7 of the shelter 1 of FIG. 3 are shown (in FIG. 4*a*) while the same is shown in FIG. 4*b* with the cover 5 in cut-away.

In this embodiment, the shelter has a side length of 220 cm and an end width of 160 cm. It has a height of 120 cm. The shelter weight is around 8 kg.

The inflatable frame arrangement 3 is again used to support the flexible cover 5 in the shelter 1 shown in FIG. 3. The inflatable frame arrangement 3 has three arched frame members 23 (which form the cross-sectional shape of the shelter 1 of a semicircle or ellipse on a rectangle) comprising two opposing end frame members 25, one at each end of the shelter 1 and an intermediate frame member 27 disposed intermediate the two end frame members 25. Each arched frame member 23 comprises two opposing lower leg portions 31 and an upper arch portion 29. An elongate upper frame member 33 (or spine member) is medially disposed and extends along the length of the shelter 1 from one end frame member 25 to the other and serve to give the shelter structure. The spine member 33 is essentially two spine member portions, each disposed between and joined to a pair of arched frame members 23 at its upper arche portion 29.

Elongate side members 35 are disposed along the length of each side of the shelter 1 again linking the end frame members 25 and the intermediate frame member 27 and is joined to each of the arched frame members 23. The side members 35 are disposed relative to the arched frame members 23 so that that the side members 35 have about 50 mm clearance from the ground.

The portion of the leg portions 31 of the arched frame members 23 that projects downwards from the point at which the side members 35 are attached to the leg portions 31 may be referred to as the foot projections 37. Each leg portion 31 of each arched frame member 23 has a foot projection 37. The frame arrangement 3 is supported by and stands on the foot projections 37.

While the cover 5 is supported by the inflatable frame arrangement 3, the cover 5 also provides support to the inflatable frame arrangement 3. Preferably, the frame members of the frame arrangement may be secured to the cover at various points. The flexible cover 3 is best secured to the inflatable frame arrangement 3, especially at end members 25, side members 35 and spine member 33.

The inflatable frame arrangement 3 typically defines a single inflatable volume, inflated by one or more typically two inflation valves 53. The inflatable frame arrangement 3 is formed in this embodiment of 80 mm diameter polyurethane tubing.

The floor 7 of the shelter 1 according to this embodiment, which floor 7 is typically made of Nylon with a weight of 80 g/m$^2$ and a tear strength of 20N, has a removable medial floor portion 41 which may be rolled back (as shown at 47) or removed to reveal a hole 45 bound by peripheral floor portion 43, which is typically 100 mm wide. The medial floor portion 41 may be removably detachable to the peripheral floor portion 43 by way of any suitable fixing such as a hook and loop fixing along the end edges 57 of peripheral floor portion 43 and optionally a zip along the side edges of peripheral floor portion 43.

The foot projections 37 are placed on the peripheral floor portion 43.

Figure 5A:
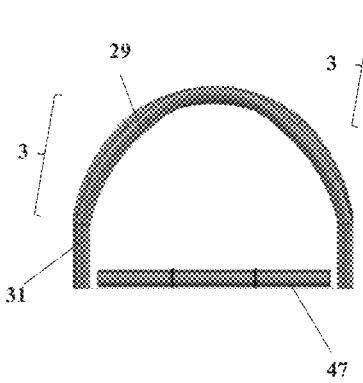
FIGS. 5*a* and 5*b* are end and side aspect views of the frame arrangement with floor of FIG. 4.
Figure 5B:
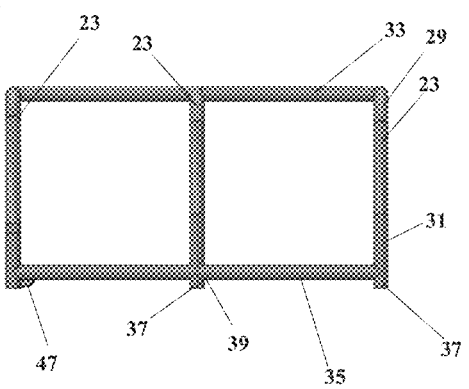

FIGS. 5*a* and 5*b* are an end aspect view and side aspect view of the inflatable frame arrangement 3 and floor 7 of FIG. 4*a*. Again, three arch frame members 23 are separated at an upper portion 29 thereof by a spine member 33 and at a leg portion 31 thereof by side members 35. The portion of leg members 31 of the arched frame members 23 that project downwards from the junction 39 of side members 35 and leg portions 31 are foot projections 37 and they serve to raise the side members 35 up from the ground by about 50 mm. This minimises the amount of inflatable tubing that is in contact with the ground, in use, thus reducing the risk of puncture. Medial floor portion 41 may be rolled up and secured as rolled-up floor 47.

This embodiment allows the entire shelter 1 to be placed over an injured person to provide shelter without injury and gives clearance.

As mentioned above, the inflatable frame arrangement 3 of the shelter 1 of the invention may be secured to a cover 3 at various points around the frame arrangement 3.

Figure 6:
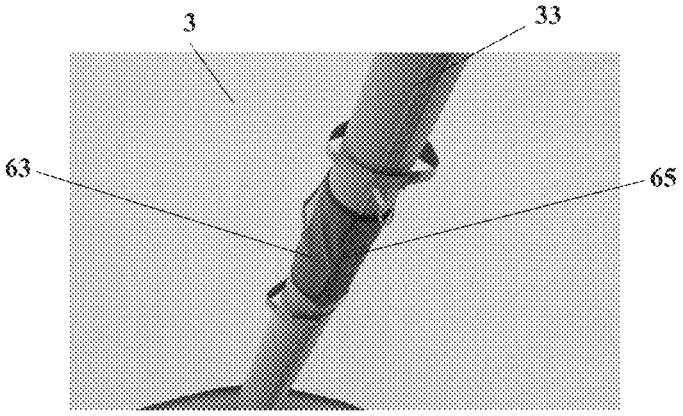
FIG. 6 is a representation of a frame member fixing for use in an embodiment of the shelter of the invention.

FIG. 6 illustrates one such method of securing the cover 5 to the frame arrangement 3. In FIG. 6, spine member 33 is secured to flexible cover 3 by way of envelope 63, which is sewn to the cover 5 at a point (not shown) above the spine member 33. The envelope 63 forms a tube shape through which the spine member 33 passes. The envelope 63 is provided in two leaves which are secured together by hook and look fixing 65.

Figure 7:
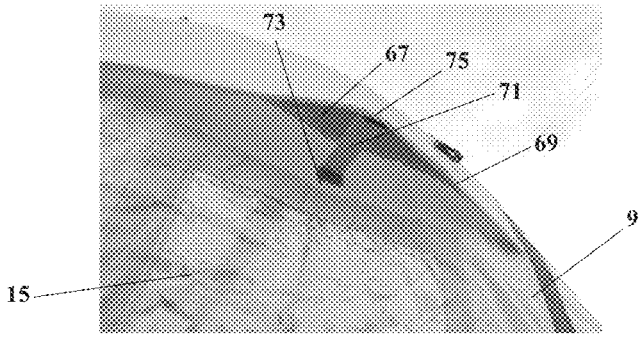
FIG. 7 is a close up view of a fixing between an arched frame member and a floor of an embodiment of the shelter of the invention.

FIG. 7 illustrates a preferred feature for use on a shelter 1 of the invention to provide ventilation to the interior of the shelter 1. According to FIG. 7, on an end wall 9 of the shelter 1, above window 15, a vent net 67 (or mosquito net) is provided at or close to the apex of the arch shaped shelter 1. The vent net 67 is ordinarily covered by a vent flap 69 of material. The vent 67 may be opened by inserting deployable stop 71 between vent flap 69 and end wall 9. The stop 71 may be held in position by hook and loop fixings 73, 75 on each end thereof which cooperate with corresponding hook and loop fixings on flap 69 and end wall 9. In order to close the flap, the stop 71 may be removed and the vent flap 69 placed against end wall 9 closing the vent 67. Vent flap 69 may be held closed in place against end wall 9 by hook and loop fixings on the vent flap 69 cooperating with hook and loop fixing on the end wall 9 or on a surface of the stop 71 at 73.

Figure 8:
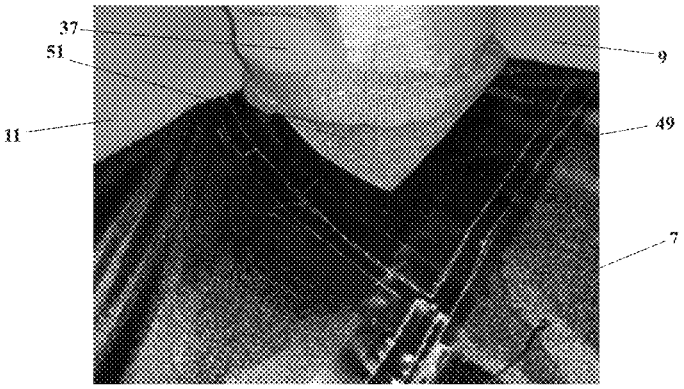
FIG. 8 is a representation of a vent arrangement for use in an embodiment of the shelter of the invention.

FIG. 8 illustrates the attachment of a foot projection 37 of an inflatable frame arrangement 3 (not shown) to the floor 7 of the shelter 1. Viewed from the interior of the shelter 1 in close up, FIG. 8 shows a foot projection 37 disposed on the floor 7 of the shelter 1 adjacent to end wall 9 and side wall 11 of the cover 5. A flat, reinforcing plate 49 of thick, but flexible material provides a shoe for the foot projection 37 and has disposed on a portion thereof a hook and loop fixing 51, the cooperating part of which is secured to the underside of foot projection 37, whereby the foot projection may be firmly secured to the shoe plate 49.

Figure 9A:
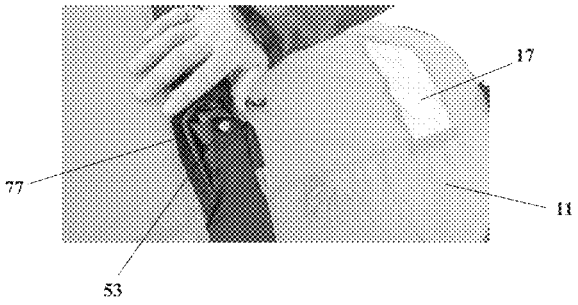
FIGS. 9*a* and 9*b* are representations illustrating valve mechanisms for use in an embodiment of the shelter of the invention.
Figure 9B:
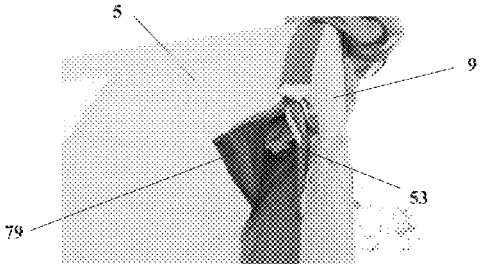

FIGS. 9*a* and 9*b* illustrate valve 53 disposed on the outer sidewall 11 of the shelter 1 at a portion thereof corresponding to an arched frame member. The valve 53 projects through the side wall 11 and may be accessed by removing valve cover 77, 79.

Figure 10:
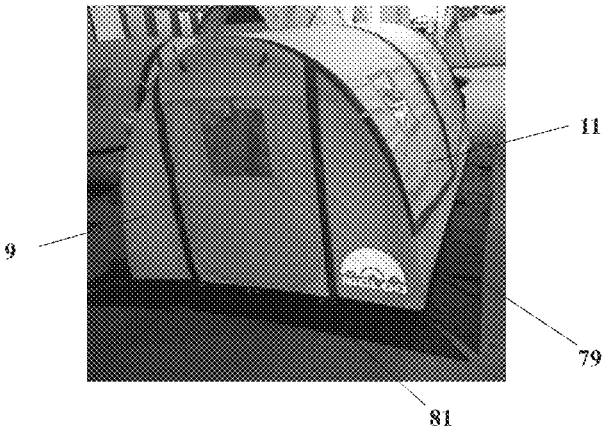
FIG. 10 is a front perspective view of another embodiment of the shelter of the invention.

FIG. 10 illustrates a further embodiment of a shelter 1 of the invention comprising a side wall 11 and an end wall 9 in which a side ballast skirt 79 and an end ballast skirt 81 are provided as thin material portions that extend laterally outwards and longitudinally outwards respectively from the base of side wall 11 and end wall 9, by about 20 to 50 cm, preferably 25 to 35 cm. The ballast skirts 70, 81 run along the full length of respective sidewall 11 and end wall 9. They may be discrete or optionally extend fully around the shelter 1. In use, a ballast skirts 79, 81, which are provided on each side and each end, may be used to weigh down the shelter to secure it in place by placing weights at various places around the shelter 1, optionally on the skirts 79,81 the full length of the respective skirts 79,81. In one example, snow may be used to weigh the shelter 1 down and keep it in place, which is particularly advantageous in snowing conditions when pegs and guy ropes are not viable.

In one particular embodiment, the shelter 1 as shown in FIGS. 3, 4*a* and 4*b* may be provided with a ballast skirt 79,81 as illustrated in FIG. 10, whereby a rescue shelter 1 may be used by removing medial floor portion 41, placing the inflated shelter over an injured person and weighing the shelter down with ballast such as snow on the ballast skirt 79,81.

The invention has been described with reference to a preferred embodiment. However, it will be appreciated that variations and modifications can be effected by a person of ordinary skill in the art without departing from the scope of the invention.

The invention claimed is:

1. A deployable shelter comprising an inflatable frame arrangement and a flexible cover disposed or formed thereover, the shelter having a deployed (and inflated) configuration and a stowed configuration, which in the deployed configuration the inflatable frame comprises at least two arched frame members, each defining an upper arch portion and two leg portion, the frame having at least one elongate upper frame member linking together the arched members at an upper portion thereof and two elongate side members, each linking the leg portions of the arched members, the elongate side members connected to the leg portions of the arched frame members so as not to be in contact with the ground or base sheet, in use, and defining, on each leg portion, a foot projection configured to make contact with the ground or base sheet, wherein the foot projection is provided with a shoe for protecting the foot projection.

2. The deployable shelter according to claim 1, wherein the side members are disposed relative to the leg portions of the arched frame members such that the foot projections extend from a junction of the side member and leg portion of an arched frame member by at least 15 mm.

3. The deployable shelter according to claim 2, wherein the foot projections extend from a junction of the side member and leg portion of an arched frame member by an amount from 20 to 250 mm.

4. The deployable shelter according to claim 1, wherein the shoe comprises a cup with a recess for receiving the foot projection or comprises a rigid plate or reinforcing element for contacting a foot projection.

5. The deployable shelter according to claim 1, wherein the shoe is disposed on, secured to or integral with a floor portion of the flexible cover.

6. The deployable shelter according to claim 1, wherein the foot projection has a base comprising a hook and loop fixing configured to cooperate with the shoe.

7. The deployable shelter according to claim 1, wherein the frame comprises at least three arched frame members.

8. The deployable shelter according to claim 1, wherein two of the arched frame members are end members.

9. The deployable shelter according to claim 1, wherein the frame comprises an upper frame member in the form of a medially disposed spine member.

10. The deployable shelter according to claim 1, wherein the flexible cover comprises a floor, two opposing end walls and two opposing side walls, which side walls together follow the form of the arched frame members to form a single curved surface.

11. The deployable shelter according to claim 1, which comprises an external perimeter skirt extending outward along each opposing side of the shelter at ground or floor level and/or extending along each opposing end of the shelter at ground or floor level.

12. The deployable shelter according to claim 1, wherein the frame arrangement comprises a single inflatable volume.

13. A deployable shelter comprising an inflatable frame arrangement and a flexible cover disposed or formed thereover, the shelter having a deployed (and inflated) configuration and a stowed configuration, which in the deployed configuration the inflatable frame comprises at least two arched frame members, each defining an upper arch portion and two leg portion, the frame having at least one elongate upper frame member linking together the arched members at an upper portion thereof and two elongate side members, each linking the leg portions of the arched members, the elongate side members connected to the leg portions of the arched frame members so as not to be in contact with the ground or base sheet, in use, and defining, on each leg portion, a foot projection configured to make contact with the ground or base sheet, wherein the flexible cover forms at least a floor of the shelter, wherein the floor comprises a peripheral floor portion; and a medial floor portion, characterized in that the medial floor portion is movable between a first configuration in which the medial floor portion together with the peripheral floor portion provide a continuous and complete floor and a second configuration in which the medial floor portion is at least partially separated from the peripheral floor portion to reveal or define a hole in the floor.

14. The deployable shelter according to claim 13, wherein the medial floor portion is removably attachable to the peripheral floor portion.

15. The deployable shelter according to claim 13, wherein the medial portion makes up at least 50% of the floor area.

16. The deployable shelter according to claim 13, wherein the peripheral floor portion is a peripheral strip adjacent all four walls of the deployable shelter.

17. The shelter according to claim 13, wherein the medial portion may be rolled, scrunched or folded toward one side or end and secured thereto to keep the hole open.

18. The deployable shelter according to claim 13, wherein the peripheral floor portion is fixedly attached or integral with side and end walls of the flexible cover.

19. A deployable shelter comprising an inflatable frame arrangement and a flexible cover disposed or formed thereover, the shelter having a deployed (and inflated) configuration and a stowed configuration, which in the deployed configuration the inflatable frame comprises at least two arched frame members, each defining an upper arch portion and two leg portion, the frame having at least one elongate upper frame member linking together the arched members at an upper portion thereof and two elongate side members, each linking the leg portions of the arched members, the elongate side members connected to the leg portions of the arched frame members so as not to be in contact with the ground or base sheet, in use, and defining, on each leg portion, a foot projection configured to make contact with the ground or base sheet, which comprises one or more external pocket disposed on each opposing side wall and/or each opposing end wall, which external pocket is disposed at ground level and extends upward to a pocket opening, for receiving a ballast.

20. The deployable shelter according to claim 19, wherein the frame arrangement comprises a single inflatable volume.

* * * * *